US006748782B1

(12) United States Patent
Nakajima et al.

(10) Patent No.: US 6,748,782 B1
(45) Date of Patent: Jun. 15, 2004

(54) ROLLING MILL, LOOSENESS ELIMINATING DEVICE OF ROLL BEARING HOUSING, ROLLING METHOD, METHOD OF MODIFYING ROLLING MILL, AND HOT FINISHING TANDEM ROLLING EQUIPMENT

(75) Inventors: Yukio Nakajima, Hitachi (JP); Takao Sakanaka, Hitachi (JP); Takashi Kamoshita, Hitachinaka (JP); Shinichi Kaga, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/088,471

(22) PCT Filed: Mar. 1, 2000

(86) PCT No.: PCT/JP00/01201

§ 371 (c)(1),
(2), (4) Date: Mar. 20, 2002

(87) PCT Pub. No.: WO01/64360

PCT Pub. Date: Sep. 7, 2001

(51) Int. Cl.[7] ..... B21B 29/00
(52) U.S. Cl. ..... 72/241.8; 72/237
(58) Field of Search ..... 72/241.8, 247, 72/238, 244, 245, 241.2

(56) References Cited

U.S. PATENT DOCUMENTS 4,727,741 A * 3/1988 Ushifusa et al. ..... 72/237
4,736,609 A * 4/1988 Schiller et al. ..... 72/244
5,806,360 A * 9/1998 Dumas ..... 72/241.8
6,029,491 A * 2/2000 Ginzburg ..... 72/247

FOREIGN PATENT DOCUMENTS

JP 60099405 A * 6/1985 ..... B21B/13/14
JP 60111702 A * 6/1985 ..... B21B/13/14
JP 05228518 A * 9/1993 ..... B21B/29/00

* cited by examiner

*Primary Examiner*—Allan Ostrager
*Assistant Examiner*—John S Goetz
(74) *Attorney, Agent, or Firm*—Crowell & Moring LLP

(57) ABSTRACT

A rolling mill, a gap-removing apparatus for roll bearing boxes, a rolling method, a modifying method for a rolling mill, and hot finish tandem rolling equipment are provided with roll bearing boxes for rotatably supporting work rolls in a housing, a first pushing device for applying a vertical balancing force or bender force to the work rolls through the roll bearing boxes, and a second pushing device for applying a pushing force in a direction orthogonal to the work roll axis in a horizontal plane to the roll bearing boxes. The first pushing device and the second pushing device are disposed to be offset from each other in the work roll axis direction. In certain arrangements, the second pushing device is disposed between a plurality of the first pushing devices in the work roll axis direction. Gaps at the roll bearing boxes in the rolling mill can be removed without enlarging the equipment in size.

6 Claims, 9 Drawing Sheets

ROLLING MILL, LOOSENESS ELIMINATING DEVICE OF ROLL BEARING HOUSING, ROLLING METHOD, METHOD OF MODIFYING ROLLING MILL, AND HOT FINISHING TANDEM ROLLING EQUIPMENT

TECHNICAL FIELD

The present invention relates to a rolling mill, a gap-removing apparatus for a roll bearing box, a rolling method, a modifying method for a rolling mill, and hot finish tandem rolling equipment.

BACKGROUND ART

In a rolling mill, a clearance is provided between a roll bearing box and a housing or a block in order to facilitate a roll exchange work, and the clearance is gradually enlarged due to sliding wear at the time of roll exchange or the like. A gap is generated due to the clearance in a horizontal direction at the roll bearing box during rolling.

Japanese Patent Laid-open No. Hei 8-108202 discloses a method of stabilizing the position of a work roll in which a support member integral with an intermediate roll bearing box is provided with a cylinder for pushing a work roll bearing box at a work roll axis level and a cylinder for pushing the housing side, thereby removing the clearances in the horizontal direction of each of bearing boxes. However, combined use of the system with a bending cylinder is not taken into consideration.

Japanese Patent Laid-open No. Sho 61-129208 describes a technique in which a bending cylinder and a gap-removing cylinder are provided. However, a reduction in size of the equipment, bending capability and gap-removing capability are not taken into account.

It is an object of the present invention to remove gaps at roll bearing boxes in a rolling mill, without enlarging the equipment in size.

DISCLOSURE OF INVENTION

The present invention is characterized in that there are provided roll bearing boxes for rotatably supporting a work roll in a housing, a first pushing device for giving a balancing force or a bender force in the vertical direction to the work roll through the roll bearing boxes, and a second pushing device for giving to the roll bearing boxes a pushing force in a direction orthogonal to the work roll axis in a horizontal plane, and the first pushing device and the second pushing device are disposed to be offset from each other in the work roll axis direction.

In addition, the present invention is characterized in that the second pushing device is disposed between a plurality of the first pushing devices as viewed along the work roll axis direction.

BEST MODE FOR CARRYING OUT THE INVENTION

Embodiment 1

Figure 1:
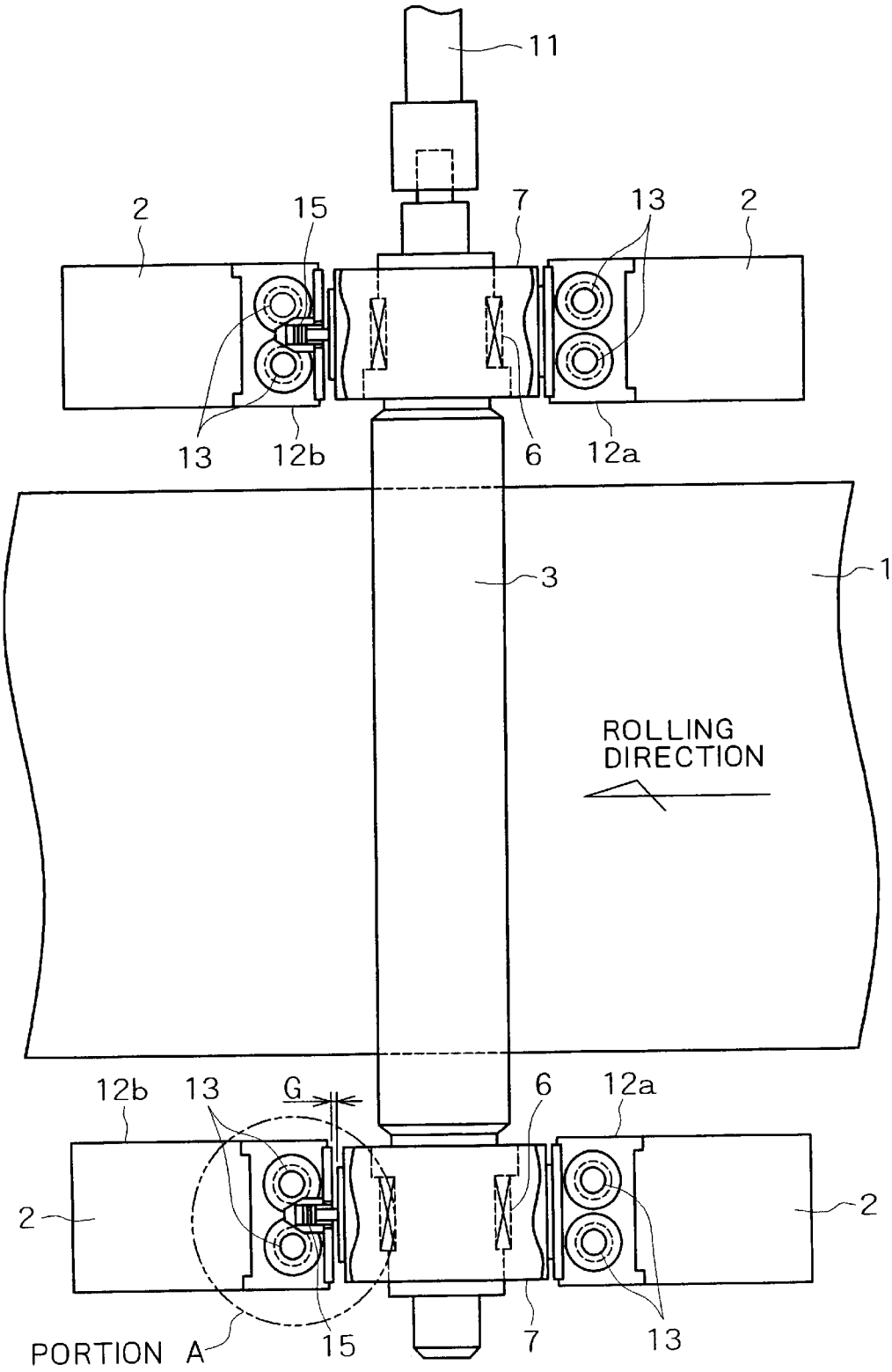
FIG. 1 is a plan view of a rolling mill according to one embodiment of the present invention.

FIG. 1 is a plan view of a rolling mill according to one embodiment of the present invention.

Figure 2:
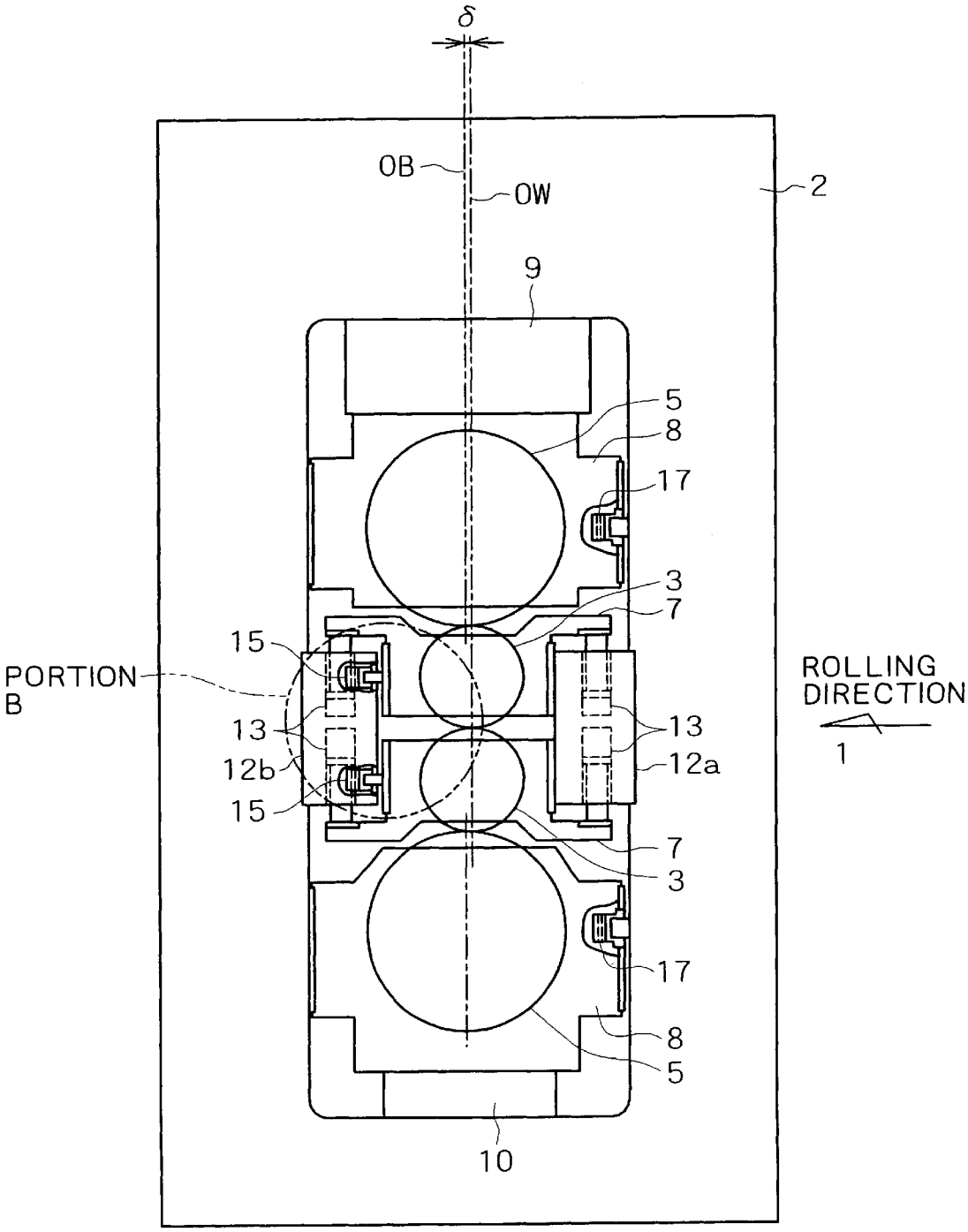
FIG. 2 is a front view of the rolling mill according to the embodiment of the present invention.

FIG. 2 is a front view of the rolling mill according to the embodiment of the present invention.

The rolling mill shown in this embodiment is a 4-high rolling mill which comprises an upper-lower pair of work rolls 3 for rolling a rolling stock 1, and an upper-lower pair of backup rolls 5 for supporting the upper-lower pair of work rolls 3, in a housing 2. The present embodiment may be applied to a rolling mill in which intermediate rolls 4 are disposed between the work rolls 3 and the backup rolls 5, as a 6-high rolling mill.

A roll-driving spindle 11 is connected to one end of the work roll 3, and a rotational driving force is transmitted to the work roll 3 through the roll-driving spindle 11, whereby the work roll 3 is rotated.

The upper-lower pair of the work rolls 3 are rotatably supported by work roll bearing boxes 7 through bearings 6 respectively, and the upper-lower pair of the backup rolls 5 are rotatably supported by backup roll bearing boxes 8 respectively.

In the present embodiment, two kinds of pushing devices are provided.

The first is a roll bending cylinder 13 for giving a bending force to the work roll 3 and for adjusting the position of the work roll 3. That is, the first pushing device can apply a desired vertical force to both ends of the work roll 3 through the work roll bearing boxes 7.

The second is a second pushing device for removing gaps, namely, a gap-removing cylinder. The second pushing device can apply a horizontal force to the work roll bearing boxes 7 and to the work roll 3 through the work roll bearing boxes 7. That is, the second pushing device can apply a desired force to the work roll 3 and the like in a direction orthogonal to the roll axis direction.

Here, the roll bending cylinder 13 which is the first pushing device is disposed between the housing 2 and a block 12 fixed or slidably disposed in the housing 2 and the work roll bearing box 7. In order to enhance the shape of a rolled plate and accuracy of the plate thickness, the roll bending cylinder 13 is desirably a hydraulic cylinder with large size and high output. The roll bending cylinders 13 are provided on the inlet side and the outlet side of both ends of the work roll. That is, the roll bending cylinders are provided at four positions for each work roll. A plurality of the roll bending cylinders 13 may be provided at each of the four positions. In this embodiment, two roll bending cylinders 13 are provided in the roll axis direction.

The force of the roll bending cylinder 13 is exerted in a vertical direction, and acts on the work roll 3 through a member in the work roll bearing box 7. Therefore, a load is applied to the bearing 6 disposed in the work roll bearing box 7. In order to elongate the useful life of the bearing 6, it is desirable that the roll bending cylinder 13 is so disposed as not to apply an unbalanced load to the bearing 6 so as to apply a load to the center of the bearing 6.

In other words, it is most effective to dispose the gap-removing cylinder at a position where the sliding axis of a gap-removing cylinder piston 18 and the sliding axis of a roll bending cylinder piston 14 intersect with each other. When the gap-removing cylinder is disposed at the position where the sliding axis of the gap-removing cylinder piston 18 and the sliding axis of the roll bending cylinder piston 14 intersect with each other, the distance between the roll bending cylinder 13 and a fixed end of a member in the roll bearing box for receiving the output of the roll bending cylinder 13 becomes large, and the bending moment will be large. Then, it is necessary to increase the size and strength of the member in the roll bearing box for receiving the output of the roll bending cylinder 13, whereby the rolling mill is enlarged in size.

Figure 4:
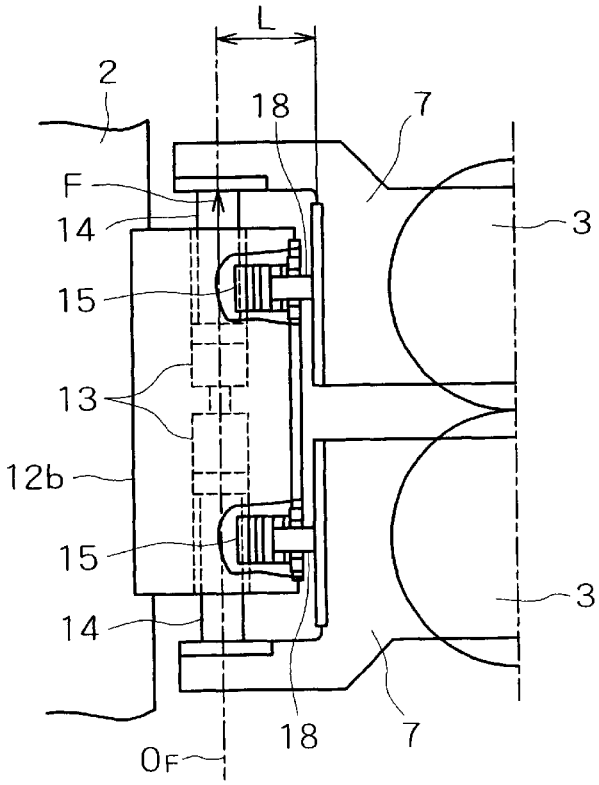
FIG. 4 is a detailed view of portion B of FIG. 2.

FIG. 4 is a partially enlarged view of FIG. 1. The bending moment M is represented as $M=F\cdot L$ (F: roll bending cylinder output, L: distance); in order to reduce the bending moment, it is necessary to shorten the distance L or to reduce the force F.

As described above, it is necessary to enlarge the output F of the roll bending cylinder 13. In order to reduce the bending moment M, therefore, it is desirable to shorten the distance between the roll bending cylinder 13 and the fixed end of the member in the bearing box for receiving the output of the roll bending cylinder 13.

When the gap-removing cylinder is used, the roll bearing box is pressed horizontally, so that a frictional resistance is generated between the roll bearing box and the housing 2 or the block 12 at the time of rolling. Since the frictional resistance acts in a direction opposite to the rolling load, it may become a noise to a load cell for measuring the rolling load, thereby producing a bad effect on the shape of the rolled plate or the accuracy of plate thickness. The frictional resistance Q is represented as $Q=K\cdot\mu$ (K: gap-removing cylinder output, $\mu$: coefficient of friction); as the output of the gap-removing cylinder increases, the frictional resistance Q increases, and the noise to the load cell increases.

Figure 3:
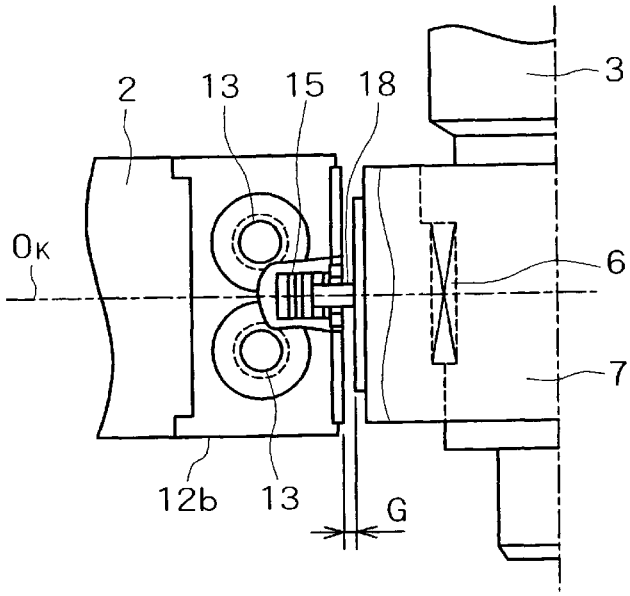
FIG. 3 is a detailed view of portion A of FIG. 1.

In addition, as shown in FIG. 3, the work roll bearing box 7 is slidably retained between an inlet-side block 12*a* disposed on the inlet side with respect to the moving direction (rolling direction) of the rolling stock 1 and an outlet-side block 12*b* disposed on the outlet side. There is a clearance G between the work roll bearing box 7 and the housing 2 or the block 2, so that the work roll bearing box 7 can be drawn out of the rolling mill as one body with the work roll 3 at the time of exchanging the work roll 3.

While the inlet-side block 12*a* and the outlet-side block 12*b* are fixed to the housing 2 in FIG. 1, blocks 12 slidable in the axial direction of the work roll 3 may be used. The inlet-side block 12*a* and the outlet-side block 12*b* may be fixed to or slidably connected to the housing 2. The inlet-side block 12*a* and the outlet-side block 12*b* are each provided with the roll bending cylinder 13 for applying a bending force to the work roll 3 through the work roll bearing box 7, and, further, the outlet-side block 12*b* is provided with a gap-removing cylinder 15, which pushes the work roll bearing box 7 in the inlet-side direction of the housing 2.

In FIGS. 3 and 4, the gap-removing cylinder 15 is so disposed that the sliding axis $O_K$ of the gap-removing cylinder piston 18 and the sliding axis $O_F$ of the roll bending cylinder piston 14 do not intersect with each other but are offset from each other. With such an arrangement, it is possible to enlarge the roll bending cylinder 13 and the gap-removing cylinder 15 in size, without enlarging the equipment as a whole in size. In short, the horizontal position of the work roll bearing box 7 is stabilized without damaging the shape controllability of the rolling stock 1. That is, with such an arrangement that the first pushing device and the second pushing device are disposed to be offset from each other, gaps at the roll bearing boxes in the rolling mill can be removed without enlarging the equipment in size.

Besides, a plurality of, for example, two first pushing devices for giving a vertical balancing force or bender force to the work roll through the roll bearing box may be provided, and the second pushing device for giving a pushing force in a direction orthogonal to the work roll axis in a horizontal plane to the roll bearing box may be disposed between the two first pushing devices in the work roll axis direction. With such an arrangement, gaps at the roll bearing boxes in the rolling mill can be removed without enlarging the equipment in size and without lowering the output capability of the balancing force or bender force.

Since the first pushing devices are disposed on both sides of the second pushing device in the roll axis direction, gaps at the roll bearing boxes in the rolling mill can be removed without enlarging the equipment in size and without lowering the output capability of the balancing force or bender force.

Rolling is conducted while the work rolls for rolling the rolling stock 1 are rotatably supported by the roll bearing boxes, a vertical balancing force or bender force is applied to the work rolls through the roll bearing boxes, and a pushing force in a direction orthogonal to the work roll axis is applied to the roll bearing boxes at a position different from the position of applying the balancing force or bender force in the roll axis direction in a horizontal plane, whereby gaps at the roll bearing boxes in the rolling mill can be removed and stable rolling can be achieved without enlarging the equipment in size and without lowering the output capability of the balancing force or bender force. Besides, rolling is conducted while the work rolls for rolling the rolling stock 1 are rotatably supported by the roll bearing boxes, a vertical balancing force or bender force is applied to the work rolls through the roll bearing boxes from a plurality of positions in the work roll axis direction, and a pushing force in a direction orthogonal to the work roll axis in a horizontal plane is applied to the roll bearing boxes from a position between the plurality of positions of applying the balancing force or bender force, whereby stable rolling can be achieved.

According to the present embodiment, the roll bearing boxes for the rolling mill are pushed horizontally by the pushing device, whereby a gap-removing cylinder with high output can be provided without damaging the output of a roll balancing cylinder or the roll bending cylinder 13.

In addition, at least two piston sliding directions of the gap-removing cylinders are provided per roll in directions orthogonal to the piston sliding directions of the roll balancing cylinder or the roll bending cylinder 13, and the gap-removing cylinder is so disposed that the piston sliding axis of the gap-removing cylinder does not intersect with and is offset from the piston sliding axis of the roll balancing cylinder or the roll bending cylinder 13, whereby a gap-removing apparatus for the roll bearing boxes capable of restraining the horizontal movement of the roll bearing boxes while making the most of the shape controlling capability of the roll bending cylinder 13 can be provided.

In the case of improving existing equipment, the roll balancing cylinder or the roll bending cylinder, the bearing boxes and the like can be existing parts, so that when the present gap-removing apparatus is disposed, the modification area can be very small, leading to the merit of a large cost-down.

In other words, by providing the second pushing device for applying a pushing force in a direction orthogonal to the work roll axis in a horizontal plane to the roll bearing boxes at a position offset from the position in the work roll axis direction of the first pushing device for applying a vertical balancing force or bender force to the work roll through the roll bearing boxes for rotatably supporting the work roll in the housing 2, it is possible to easily perform a modifying work and to achieve a modification of adding the gap-removing mechanism, without damaging the capability of the balancing force or bender force.

Furthermore, in the cases of a 4-high rolling mill or a 6-high rolling mill, for example, even when a gap-removing cylinder is provided for the work roll bearing boxes to stabilize the work roll position, there may be cases where the work roll position is not stabilized due to instability of the position of other roll for supporting the work roll 3. Therefore, by arranging the gap-removing cylinder for the work roll bearing boxes in combination with a gap-removing cylinder for stabilizing the position of the roll for supporting the work roll 3, further stable rolling can be achieved.

Embodiment 2

Next, the case of making the work roll 3 offset will be described.

At the time of nipping the rolling stock 1, an excessive horizontal force is generated on the inlet side in the work rolls 3, while a horizontal force is generated on the outlet side due to the reactional force in the support rolls for supporting the work rolls 3. The support rolls are backup rolls 5 in the case of a 4-high rolling mill, and are intermediate rolls 4 in the case of a 6-high rolling mill.

Figure 5:
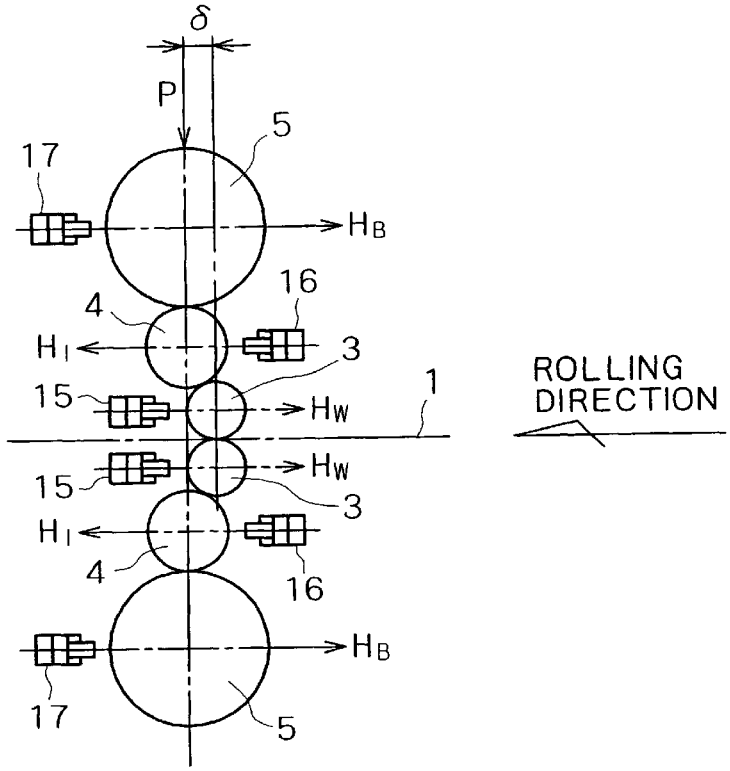
FIG. 5 is an illustration of an offset horizontal component acting on each roll at the time of rolling.

At the time of steady rolling, the direction in which an offset horizontal component of the work rolls 3 is generated is as shown in FIG. 5. That is, in the case where the work rolls 3 are offset to the inlet side with respect to the rolls for supporting the work rolls 3, the horizontal force generated in the work rolls 3 is exerted in the inlet-side direction. Then, the horizontal force generated in the intermediate rolls 4 which are the rolls for supporting the work rolls 3 is exerted in the outlet-side direction.

Thus, the direction of the horizontal force generated in each roll during rolling varies according to the rolling condition and the offset direction, and, therefore, the direction in which the gap-removing cylinder pushes the roll bearing boxes is important.

In addition, for example, even where the work rolls 3 are provided with a gap-removing cylinder and the work roll bearing boxes 7 are pushed horizontally, the rolls for supporting the work rolls 3 are not mechanically restrained in horizontal directions, so that the horizontal position thereof becomes unstable. There is also the problem that the direction and magnitude of the offset horizontal force generated in the work rolls 3 through the rolls for supporting the work rolls 3 become unstable.

As shown in FIG. 2, a rolling load is applied to the backup roll bearing boxes 8 by a draft jack 9, and further applied to the work rolls 3 through the backup rolls 5, whereby the rolling stock 1 is rolled. The rolling load is measured by a draft load cell 10.

The axis OW of the work roll 3 is offset to the inlet side of the rolling stock 1 from the axis OB of the backup roll 5 by δ.

In the case of the roll constitution shown in FIG. 2, the offset horizontal component acting on the work rolls 3 is exerted in the inlet-side direction of the rolling stock 1. Therefore, work roll gap-removing cylinders 15 are disposed at the outlet-side block 12*b*, and the work roll bearing boxes 7 are pushed against the inlet-side block 12*a*. The offset horizontal component acting on the backup rolls 5 is exerted in the outlet-side direction of the rolling stock 1 due to receiving of a reactional force of the offset horizontal component of the work rolls 3. Therefore, backup roll gap-removing cylinders 17 are disposed on the inlet side of the backup roll bearing boxes 8, and the backup roll bearing boxes 8 are pushed to the outlet side of the housing 2.

While the backup roll gap-removing cylinders 17 are provided at the backup roll bearing boxes 8, the backup roll gap-removing cylinders 17 may be provided on the inlet side of the housing 2, and the backup roll bearing boxes 8 may be pushed to the outlet side of the housing 2.

With the work roll gap-removing cylinders 15 and the backup roll gap-removing cylinder 17 thus arranged, (offset horizontal component)+(gap-removing cylinder output) acts on each roll bearing box during rolling, whereby the horizontal movement of the roll bearing boxes during rolling can be restrained.

For example, in FIG. 2, the housing 2 is pushed by the work roll gap-removing cylinders 15, whereby the work roll bearing boxes 7 may be clamped between the inlet-side block 12*a* and the outlet-side block 12*b* to thereby restrain the horizontal movement of the work roll bearing boxes 7.

FIG. 5 shows an example in which a 6-high rolling mill is provided with gap-removing cylinders according to the present invention. In this figure, the axis of the work roll 3 is offset from the axes of the intermediate roll 4 and the backup roll 5 to the inlet side of the rolling stock 1 by δ. When the work rolls 3 are offset to the inlet side and a rolling load P is applied, an offset horizontal component $H_W$ acts on the work rolls 3 in the inlet-side direction, while an offset horizontal component $H_I$ acts on the intermediate rolls 4 in the outlet-side direction opposite to $H_W$ and as a reactional force of $H_W$. Further, an offset horizontal component $H_B$ acts on the backup rolls 5 in the inlet-side direction opposite to $H_I$ and as a reactional force of $H_I$.

The work roll gap-removing cylinders 15, the intermediate roll gap-removing cylinders 16 and the backup roll gap-removing cylinders 17 are disposed so as to push each of the roll bearing boxes in the direction in which the offset horizontal component acting on each of the rolls is generated, whereby the horizontal movement of each roll bearing box during rolling can be restrained. In FIG. 5, since the axes of the intermediate roll 4 and the backup roll 5 are not offset from each other, the offset horizontal component $H_B$ acting on the backup roll 5 is very small. In this case, therefore, the intermediate rolls 4 and the backup rolls 5 may be pushed in the same direction, namely, to the outlet side.

That is, the backup roll bearing boxes may be pushed to the outlet side by the backup roll gap-removing cylinders 17.

In addition, in a rolling mill comprising first roll bearing boxes for the work rolls and second roll bearing boxes for support rolls for supporting the work rolls, a pushing device for applying a pushing force in a direction orthogonal to the work roll axis in a horizontal plane to the first roll bearing boxes is provided on the outlet side of the rolling mill, and a pushing device for applying a pushing force in a direction orthogonal to the work roll axis in a horizontal plane to the second roll bearing boxes is provided on the inlet side of the rolling mill, whereby stabilization of the rolls in horizontal directions can be contrived. This promises a particularly remarkable effect where the work rolls are offset.

Besides, the roll and the direction in which the horizontal force is generated vary according to the type of the rolling mill. Therefore, it is unnecessary in some cases to provide the gap-removing cylinders of the present invention for all rolls. Thus, for example, only the gap-removing cylinders 15 for the work rolls may be provided, or a combination of the work roll gap-removing cylinders 15 and the backup roll gap-removing cylinders 17 may be provided.

Figure 6:
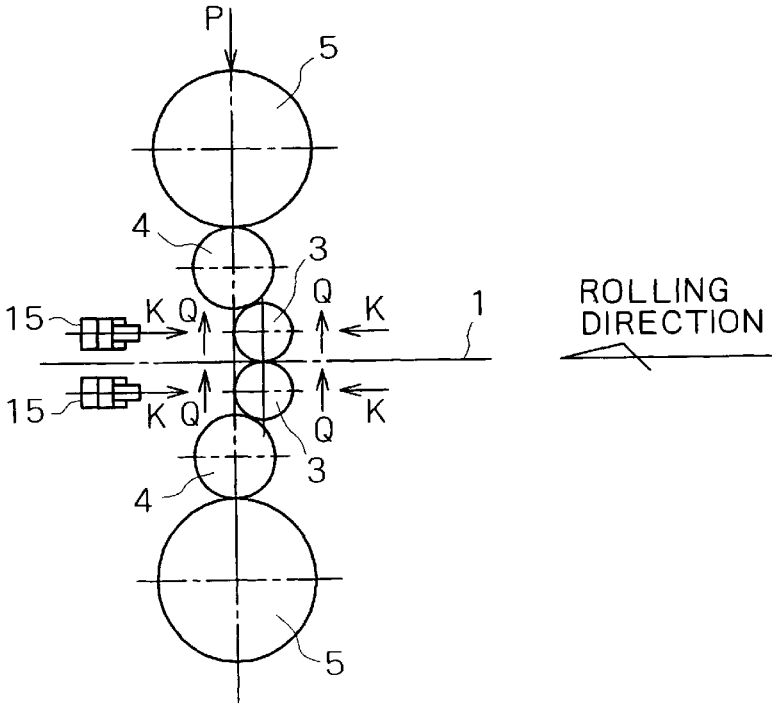
FIG. 6 is an illustration of the resistance of a gap-removing cylinder against a rolling load.

FIG. 6 shows an example of the resistance Q of the gap-removing cylinders against the rolling load P in the case where the work roll gap-removing cylinders 15 are provided. In this figure, in order to show the relationship between the rolling load P and the resistance Q of the gap-removing cylinders, other forces are omitted. Since the work rolls 3 are offset to the inlet side with respect to the intermediate rolls 4 and the backup rolls 5, the work roll gap-removing cylinders 15 are provided on the outlet side, and the work roll bearing boxes are pushed to the inlet side. When the work roll bearing boxes are pushed to the inlet side with an output K by the work roll gap-removing cylinders 15, the work roll bearing boxes receive a reactional force K from the housing 2 or the block 12 on the inlet side.

When a rolling load P is applied in the condition where the output of the work roll gap-removing cylinder 15 is K, a frictional resistance Q in the opposite direction to the rolling load P is generated at a contact surface between the work roll gap-removing cylinder 15 and the work roll bearing box and at a contact surface between the inlet side of the work roll bearing box and the housing 2 or the block 12 on the inlet side. The frictional resistance Q is represented as $Q=K\cdot\mu$ ($\mu$: coefficient of friction). Here, two contact surfaces are present per one work roll bearing box, two work roll bearing boxes are present per one work roll 3, and there are two (upper and lower) work rolls 3, so that there are eight surfaces where the frictional resistance is generated, in the case of this figure. Therefore, the total of the frictional resistance Q is $\Sigma Q=8\cdot Q=8\cdot K\cdot\mu$, so that the resistance to the rolling load P increases according to the magnitude of the output K of the work roll gap-removing cylinder 15.

As has been described above, there is the problem that when the frictional resistance Q increases, the noise to the load cell for measuring the rolling load P increases, and the shape of the rolled plate and the accuracy of the plate thickness are worsened. Therefore, it is preferable to reduce the output K of the work roll gap-removing cylinder 15 and thereby to reduce the noise to the draft load cell at the time of steady rolling in which the horizontal positions of the work rolls 3 are comparatively stable.

With the direction of pushing of the roll bearing boxes by the gap-removing cylinders set in the same direction as the acting direction of the offset horizontal force received by the roll, the force of (offset horizontal component)+(gap-removing cylinder output) acts on the roll bearing boxes as a horizontal force, so that stable rolling can be achieved.

Since the horizontal forces due to the offset horizontal components acting on the work roll 3 and on the roll for supporting the work roll 3 are in opposite directions due to the action-reaction relationship, the direction of pushing the roll bearing boxes by the gap-removing cylinders are exerted also in opposite directions.

Even where the horizontal force generated in the roll at the time of nipping the plate is exerted in the direction opposite to the offset horizontal component, a gap-removing cylinder with high output can be provided by making the piston sliding axis of the roll balancing cylinder or the roll bending cylinder 13 offset from the piston sliding axis of the gap-removing cylinder. Therefore, by setting the direction of pushing the bearing box by the gap-removing cylinder in the same direction as the direction of the offset horizontal component, a horizontal force greater than the horizontal force generated at the time of nipping can be made to act on the roll bearing box, whereby the horizontal position of the roll can be stabilized.

In addition, by an arrangement in which the work rolls are offset in a direction orthogonal to the work roll axis in a horizontal plane and the second pushing device pushes the roll bearing boxes in the direction of the offset horizontal force of the work rolls, a pushing force of (offset horizontal component)+(gap-removing cylinder output) can be obtained, so that gap removal can be achieved with very good efficiency.

Besides, by varying the output of the gap-removing cylinders according to the rolling conditions, it is possible to minimize the noise to the draft load cell 10 at the time of steady rolling, produce a rolling stock 1 with good plate shape and good plate thickness accuracy, and reduce the meandering or necking of the rolling stock 1 at the time of rolling.

Next, even when the horizontal force generated at the time of nipping is large and the roll bearing boxes are moved in the direction opposite to the acting direction of the offset horizontal component, the positions of the roll bearing boxes can be returned in the acting direction of the offset horizontal component and be stabilized immediately after the nipping by (offset horizontal component)+(gap-removing cylinder output).

However, there is the problem that if the gap-removing cylinders with high output are used also at the time of steady rolling, the noise to the draft load cell is enlarged as has been described above. However, the positions of the rolls at the time of steady rolling are comparatively stable, so that the output of the gap-removing cylinders may be low. Thus, the problem can be solved by using the gap-removing cylinders at high output when an excessive horizontal force acts on the rolls, as at the time of nipping the plate, and using the gap-removing cylinders at low output when the horizontal positions of the rolls are comparatively stable, as at the time of steady rolling.

As a means for this purpose, there may be mentioned a method in which the circuit for supplying a hydraulic pressure to the gap-removing cylinders is made to be a high-pressure/low-pressure changeover circuit. In addition, in the case where the positions of the rolls are sufficiently stable due to the offset horizontal components at the time of steady rolling, there may be adopted a method in which the gap-removing cylinders are used only when a large horizontal force acts on the rolls, as at the time of nipping the plate, and the gap-removing cylinders are not used at the time of steady rolling.

Figure 8:
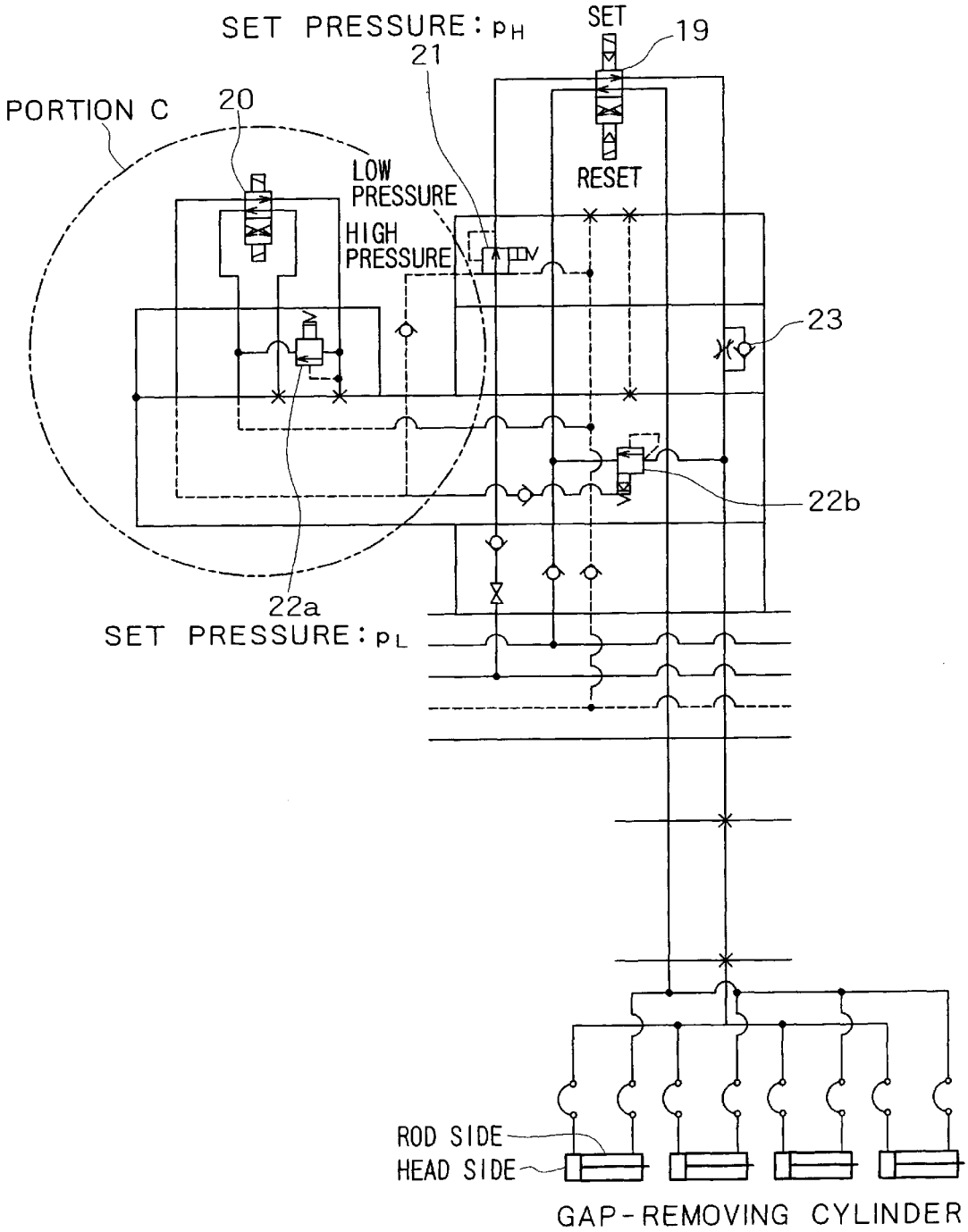
FIG. 8 shows a high-pressure/low-pressure changeover oil circuit according to one embodiment of the present invention.

An example of a hydraulic circuit for supplying a hydraulic pressure to the gap-removing cylinders according to the present embodiment is shown in FIG. 8. The oil hydraulic circuit for supplying a hydraulic pressure to the gap-removing cylinders is separate from a supplying circuit for the roll bending cylinders 13. Therefore, the two circuits can be controlled independently from each other. The present circuit comprises a solenoid valve 19 which is a switching device for setting (ON) and resetting (OFF) the gap-removing cylinders, a solenoid valve 20 which is a changeover device for changing over a high pressure and a low pressure, a pressure reduction valve 21 for setting the pressure, a relief valve 22, and a flow control valve 23. Portion C in FIG. 8 is the circuit for changing over the high pressure and the low pressure.

When the solenoid valve 19 is switched to the set side, a hydraulic pressure is supplied to the head side 15*a* of the gap-removing cylinder 15, whereby the gap-removing cylinder 15 can be set into a use condition. When the solenoid valve 19 is switched to the reset side opposite to this figure, an oil hydraulic pressure is supplied to the rod side 15*b* of the gap-removing cylinder 15, whereby the gap-removing cylinder 15 is retracted, and the gap-removing cylinder 15 can be set into a non-use condition. Next, the setting of a low pressure and a high pressure in use of the gap-removing cylinder 15 will be described.

FIG. 8 shows the condition where the gap-removing cylinder is set at a low pressure. To achieve a low-pressure setting, first, the solenoid valve 20 is set to a low pressure, a relief valve 22*a* in the circuit of portion C is set to a low pressure $P_L$, and the hydraulic pressure in the circuit of portion C is set to $P_L$. Owing to the pressure in portion C, the set pressure of a relief valve 22*b* for varying the relief pressure is at a low pressure $P_L$, and the hydraulic pressure supplied to the gap-removing cylinder 15 is a low pressure $P_L$, SO that the output of the gap-removing cylinder is a low-pressure output.

When the solenoid valve 20 is set at a high pressure reverse to this figure, the oil does not pass through the relief valve 22*a*, so that the hydraulic pressure in the circuit of portion C is a high pressure $P_H$. Then, the set pressure of the relief valve 22*b* is also a high pressure $P_H$, so that the oil hydraulic pressure supplied to the gap-removing cylinder 15 is a high pressure $P_H$, and the output of the gap-removing cylinder 15 is a high-pressure output.

With such a constitution, the output of the gap-removing cylinders 15 can be varied.

As has been described above, since the second pushing device is provided with at least one of a changeover device for varying a pushing force and a changeover device for reducing the pushing force to 0, it is possible to solve the problem that the noise to the draft load cell is enlarged, which is generated when the gap-removing cylinder with high output is used at the time of steady rolling.

Embodiment 3

Next, a mode for utilizing the rolling mill to which the present invention is applied will be described.

Hot finish tandem rolling equipment comprises rolling mills disposed in tandem, and rolling is conducted to obtain a gradually thinner plate or sheet. In this equipment, thicker plates are rolled at former stages, and thinner sheets are rolled at latter stages. Therefore, nipping of the rolling stock 1 and rolling become gradually more difficult at the latter stages. Furthermore, an effect on the product quality is increased at the latter stages, the shape of the rolled plate or sheet and the accuracy of plate thickness are more strictly limited at the latter stages, and therefore, stabilization of the roll position at the time of rolling becomes more important at the latter-stage rolling mills.

Figure 7:
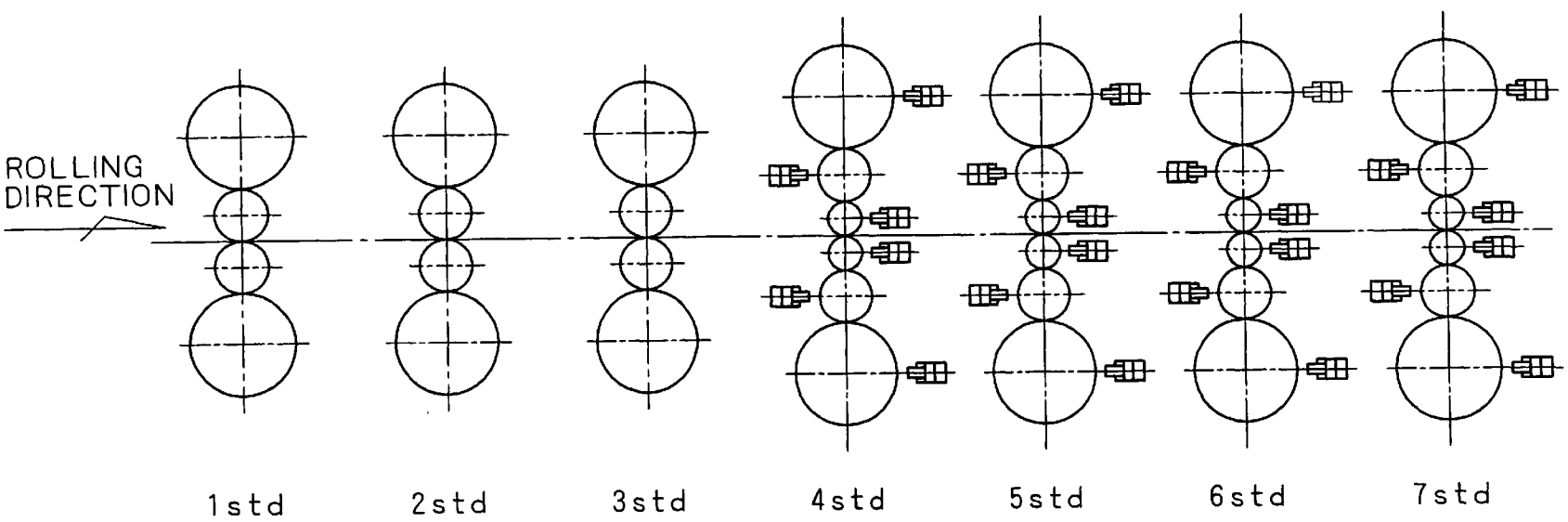
FIG. 7 is a diagram of hot finish tandem rolling equipment according to another embodiment of the present invention.

FIG. 7 shows an example in which the gap-removing cylinder according to the present invention is provided in hot finish tandem rolling equipment. The rolling equipment of FIG. 7 is tandem rolling equipment comprising seven stands (7 std), in which the first to third stands are 4-high rolling mills, and the fourth to seventh stands are 6-high rolling mills.

In this embodiment, the gap-removing cylinders according to the present invention are provided in the fourth to seventh stands which constitute the latter stages. The gap-removing cylinders are provided for all rolls in the fourth to seventh stands; however, the gap-removing cylinders may be provided only for the work rolls 3, or may be provided for the work rolls 3 and other rolls in combination.

By providing the gap-removing cylinders of the present embodiment for the latter stages of the hot finish tandem rolling equipment, for example, the fourth to seventh stands in 7-stand tandem rolling equipment, it is possible to provide equipment which can stably roll thin sheets, can obtain the good shape of a product sheet and good accuracy of sheet thickness, and can reduce such troubles as meandering and necking of the rolling stock 1.

Thus, in the hot finish tandem rolling equipment comprising a plurality of rolling mills disposed in tandem and performing finish rolling in a hot condition, a rolling mill disposed on a latter stage in the rolling equipment is provided with roll bearing boxes for rotatably supporting the work rolls in a housing 2, a first pushing device for applying a vertical balancing force or bender force to the work rolls through the roll bearing boxes, and a second pushing device for applying a pushing force in a direction orthogonal to the work roll axis in a horizontal plane to the roll bearing boxes, and the first pushing device and the second pushing device are disposed to be offset from each other in the work roll axis direction, whereby particularly stabilization of rolling can be expected.

Embodiment 4

Next, an example in which a plurality of first pushing devices and a plurality of second pushing devices are provided will be described.

Figure 9:
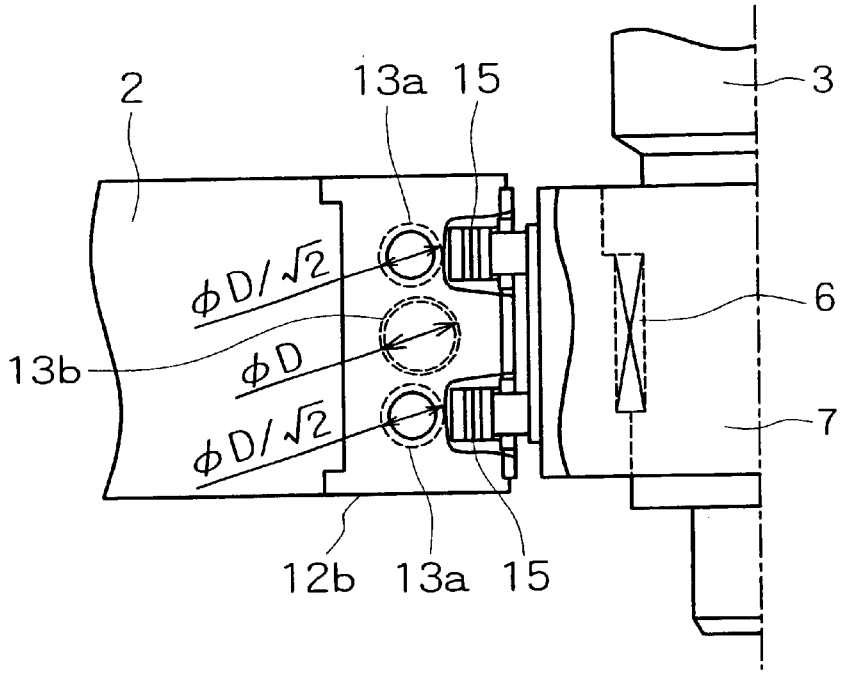
FIG. 9 is a partial plan view of a rolling mill according to one embodiment of the present invention.
Figure 10:
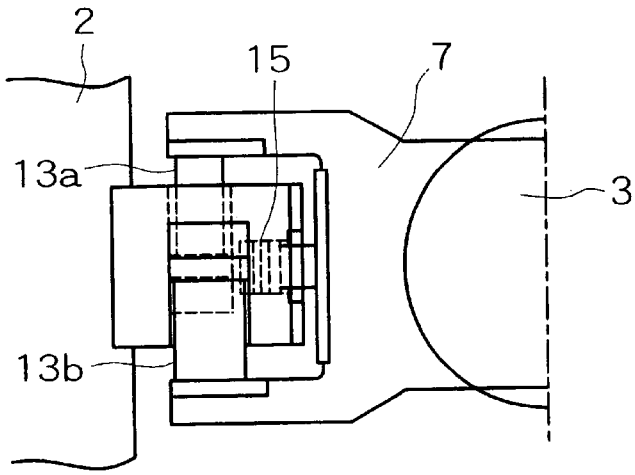
FIG. 10 is a partial front view of a rolling mill according to one embodiment of the present invention.

First, a description will be made in the case where both an increase bender 13*a* for applying a bending force in a concave direction to the work rolls and a decrease bender 13*b* for applying a bending force in a convex direction to the work rolls are provided. FIGS. 9 and 10 respectively show a partial plan view and a partial front view of a rolling mill which is one embodiment of the present invention, in which the increase benders 13*a* and the decrease bender 13*b* are provided.

The outputs of these benders are determined by the roll strength. In order to display the increase bender force and the decrease bender force to the maximum, it is preferable to provide cylinders so that the increase bender force and the decrease bender force become the same output. For example, in the case where two increase benders 13*a* and one decrease bender 13*b* are provided in the block 12*b*, the diameter of the decrease bender 13*b* is made to be $\phi D$, and the diameter of the increase benders 13*a* is made to be $\phi D/\sqrt{2}$. By thus equalizing the areas of action of the hydraulic pressure, the resultant force of the two increase benders and the force of one decrease bender can be made to be equal outputs.

In this case, a gap-removing cylinder may be disposed between the increase bender 13*a* and the decrease bender 13*b*. It is necessary that the block 12*b* has strength conforming to the decrease bender 13*a* having a larger diameter; therefore, even where the position of the increase bender 13*a* having a smaller diameter and the position of the gap-removing cylinder 15 coincide with each other, it is unnecessary to enlarge the block in size, and the equipment is not enlarged in size. That is, in the case where the gap-removing cylinder is provided in the block comprising bending cylinders of different diameters, the position of the bending cylinder having a larger diameter and the position of the gap-removing cylinder are offset from each other, whereby an appropriate bending capability can be maintained without enlarging the equipment in size.

Figure 11:
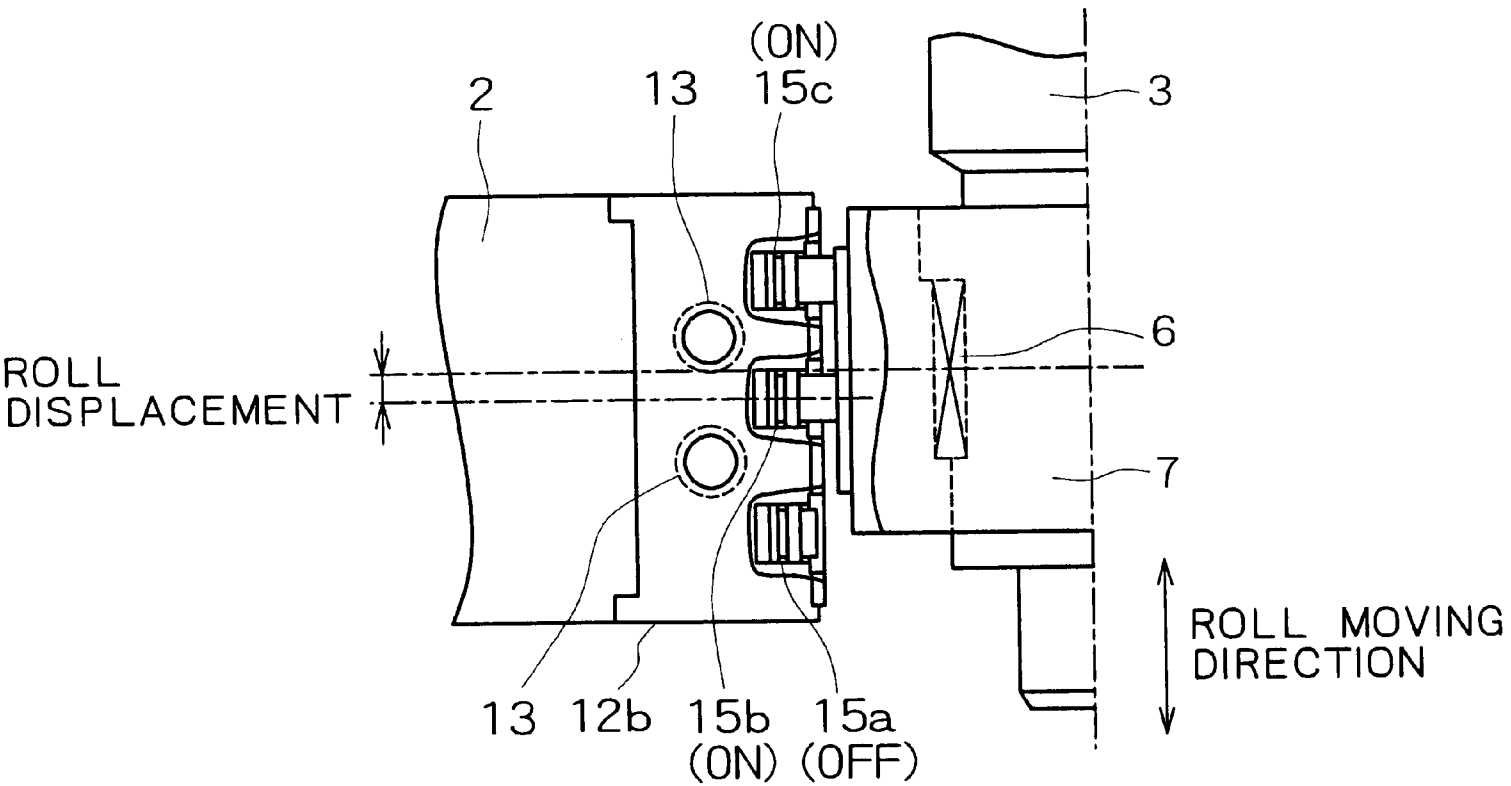
FIG. 11 is a partial plan view of a rolling mill according to one embodiment of the present invention.
Figure 12:
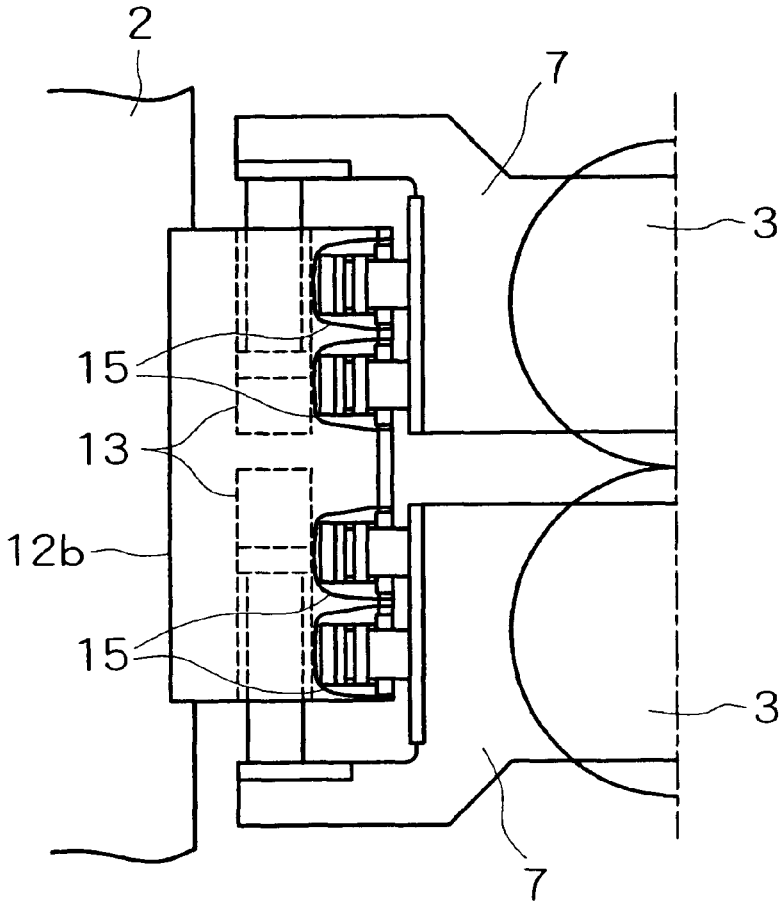
FIG. 12 is a partial front view of a rolling mill according to one embodiment of the present invention.

Next, a description will be made of the case where a plurality of gap-removing cylinders 15 are provided. FIGS. 11 and 12 respectively show a partial plan view and a partial front view of a rolling mill which is one embodiment of the present invention, in which a plurality of gap-removing cylinders are provided.

In a roll shift rolling mill in which the work roll is moved in the axial direction, the roll bearing box 7 is also moved in the axial direction due to the movement of the work roll 3 in the axial direction, so that in some cases the gap-removing cylinder 15 comes off from the roll bearing box 7 and it cannot achieve horizontal pushing. This problem can be solved by disposing a plurality of gap-removing cylinders 15 in the axial direction. For example, in the present embodiment, two rows of gap-removing cylinders are arranged in the vertical direction, and three rows of gap-removing cylinders are arranged in the roll axis direction.

As shown in FIGS. 11 and 12, the work roll 3 is moved in the roll axis direction, whereby the gap-removing cylinder 15*a* comes off from the roll bearing box 7. In this embodiment, a plurality of gap-removing cylinders 15 are arranged in the roll axis direction. With this configuration, even when the position of the work roll 3 in the roll axis direction is changed and the gap-removing cylinder 15*a* comes to a position off from the roll bearing box 7, the gap-removing cylinders 15*b* and 15*c* can be set to positions for pushing the roll bearing box 7 horizontally. Therefore, it is possible to restrain the movement of the horizontal position of the work roll 3 during rolling.

Furthermore, by providing a plurality of gap-removing cylinders 15 in the vertical direction and the roll axis direction, the roll bearing box can be pushed horizontally with high output, which is more effective.

In the roll shift rolling mill in which the work roll is moved in the axial direction, however, there is the problem that the axial movement of the roll 3 is hampered if the gap-removing cylinder 15*a* located at a position off from the roll bearing box 7 is left in a use condition. In order to solve this problem, it is preferable that the oil hydraulic system shown in FIG. 8 described above is provided for each cylinder, the cylinders are operated independently, and the gap-removing cylinders 15*b*, 15*c* located at positions suitable for pushing the roll bearing box 7 are selectively put into use condition, whereas the gap-removing cylinder 15*a* located at a position unsuitable for pushing the roll bearing box 7 is put into non-use condition, so that the axial movement of the work roll 3 is not hampered.

Industrial Applicability

In relation to a rolling mill, a gap-removing apparatus for a roll bearing box, a rolling method, a modifying method for a rolling mill, and hot finish tandem rolling equipment, the gaps at the roll bearing boxes in a rolling mill can be removed and stabilization of rolling can be contrived, without enlarging the equipment in size.

What is claimed is:

1. A rolling mill comprising:

roll bearing boxes for rotatably supporting work rolls in a housing;

a plurality of first pushing devices differing in size for applying a vertical balancing force or bender force to a respective one of said work rolls through a respective one of said roll bearing boxes; and a second pushing device for applying a horizontal pushing force to the respective one of said roll bearing boxes in a direction orthogonal to a direction of an axis of the respective work roll supported by the respective one of said roll bearing boxes to thereby reduce a gap between the respective one of said roll bearing boxes and the housing, wherein the second pushing device and the larger of said first pushing devices are disposed to be offset from one another in an axial direction of the respective work rolls supported by the respective one of said roll bearing boxes.

2. A rolling mill according to claim 1, wherein said second pushing device is provided with at least one of a changeover device for varying the pushing force of said second pushing device and a changeover device for reducing the pushing force of said second pushing device to 0.

3. A rolling mill according to claim 1, further comprising back-up rolls for supporting said work rolls, wherein vertical axes of said work rolls and back-up rolls for supporting said work rolls are offset from each other in a direction orthogonal to the work roll axis in a horizontal plane, and wherein said second pushing device pushes said respective one of said roll bearing boxes in a direction of the offset horizontal component of said work rolls with respect to an associated back-up roll.

4. A rolling mill according to claim 1, further comprising a third pushing device for applying a pushing force to the respective one of the roll bearing boxes in a direction orthogonal to the work roll axis in a horizontal plane.

5. A rolling mill according to claim 1, comprising a plurality of said second pushing devices for said respective one of said rolling bearing boxes.

6. A rolling mill according to claim 1, further comprising a moving device for moving respective ones of said work rolls in an axial direction of the work roll, a plurality of said second pushing devices spaced from one another in at least one of the vertical direction and the roll axis direction of respective ones of said roll bearing boxes, and a means for individually controlling the pushing forces of said plurality of second pushing devices.

* * * * *